United States Patent [19]

Schwartz et al.

[11] Patent Number: 4,721,933

[45] Date of Patent: Jan. 26, 1988

[54] DUAL MODE WAVEGUIDE FILTER EMPLOYING COUPLING ELEMENT FOR ASYMMETRIC RESPONSE

[75] Inventors: Craig Schwartz, Lawndale; Louis Hendrick, Hermosa Beach; Joseph Elliott, Los Angeles, all of Calif.

[73] Assignee: Hughes Aircraft Company, Los Angeles, Calif.

[21] Appl. No.: 902,810

[22] Filed: Sep. 2, 1986

[51] Int. Cl.[4] ..... H01P 1/208; H01P 7/06

[52] U.S. Cl. ..... 333/212; 333/209; 333/230

[58] Field of Search ..... 333/208–212, 333/202, 239, 248, 227–235

[56] References Cited

U.S. PATENT DOCUMENTS 2,626,990 1/1953 Pierce ..... 333/212 X 4,453,146 6/1984 Fiedziuszko ..... 333/212

FOREIGN PATENT DOCUMENTS 0103655 8/1979 Japan ..... 333/212

*Primary Examiner*—Marvin L. Nussbaum

*Attorney, Agent, or Firm*—S. M. Mitchell; M. J. Meltzer; A. W. Karambelas

[57] ABSTRACT

A dual mode circular-type waveguide filter (10) has a cylindrical waveguide body (12) separated by septums (16, 18) into a plurality of resonant waveguide cavities (22, 24, 26). Mutually orthogonal electromagnetic fields (37, 81) in adjacent cavities (24, 26) are electromagnetically coupled with each other by an internal coupling element (60) which is mounted on one of the septums (18) and extends into the adjacent cavities. The coupling element comprises an elongate, conductive wire which includes a first portion (62) extending into one of the cavities and forming a magnetic loop, and a second portion (64) extending into the adjacent cavity and forming an electric probe. The coupling element provides an asymmetrical stopband pole (72a) in the frequency response (70) of the filter.

15 Claims, 7 Drawing Figures

DUAL MODE WAVEGUIDE FILTER EMPLOYING COUPLING ELEMENT FOR ASYMMETRIC RESPONSE

TECHNICAL FIELD

The present invention broadly relates to electromagnetic waveguide filters, especially of the dual mode type having an asymmetric stopband response. More particularly, the invention involves a device for coupling mutually orthogonal electromagnetic fields between adjacent cavities in the filter.

BACKGROUND ART

Waveguide filters are often employed, for example, in microwave communication systems for the purpose of determining a system's frequency response characteristics. Such filters may operate in a single mode or may be of a dual mode type in which two electromagnetic propagated waves extend orthogonal to each other within the waveguide filter.

A typical waveguide filter comprises a symmetrical hollow body which may be cylindrical, for example, in the case of a circular waveguide, and is divided into a plurality of resonant cavities by partitions sometimes referred to as "septums" . In the case of a dual mode-type waveguide filter, each cavity defines two sections of the filter, thus, a dual mode waveguide filter having three cavities possesses six sections, including an input section and an output section. The mutually orthogonal electromagnetic fields are passed between adjacent cavities through intersecting slots defining a cross-shaped iris in each of the septums.

It is known to provide adjustable metallic screws which extend through the body of the filter into the cavities in order to effect electromagnetic coupling between orthogonal fields which are present in the same cavity. It is also known to effect coupling between mutually orthogonal fields which are respectively present in different cavities. The degree of coupling between the fields alters the device's frequency response by altering the stopband poles which determine such response.

The previous technique for coupling mutually orthogonal electromagnetic fields in different cavities involves the use of a coax cable external to the waveguide filter body which connects different sections of two cavities. This approach presents a number of problems, however. For example, the cables often result in spurious responses and are relatively complex in terms of the number of parts required to accomplish the task and the time required to assemble them. Moreover, the length of the cable is critical to frequency response and a considerable amount of time is necessary to determine the proper cable length so as to tune the filter properly.

The present invention is intended to overcome each of the deficiencies mentioned above.

SUMMARY OF THE INVENTION

According to the present invention, a dual mode electromagnetic waveguide filter is provided which provides for electromagnetic coupling between mutually orthogonal electromagnetic fields in adjacent resonant cavities of the filter. The waveguide filter broadly includes a waveguide body for containing and guiding electromagnetic energy, at least one partition or septum within the waveguide body which defines first and second adjacent resonant waveguide cavities and means within the waveguide body for electromagnetically coupling first and second mutually orthogonal fields in adjacent cavities. The mutually orthogonal fields are coupled by an elongate, conductive coupling element which is mounted on and extends through the septum. The coupling element includes a first L-shaped probe portion extending into one of the cavities and forming an electric probe. The probe portion is oriented parallel to the field to be coupled in the corresponding cavity. The coupling element further includes a second, generally U-shaped portion which extends into the adjacent cavity and defines a magnetic loop which is oriented parallel to the field in that cavity.

In the preferred form of the invention, the filter possesses three resonant cavities defining six filter sections, including an input section and an output section. Each septum is provided with a cross-shaped iris or opening allowing the orthogonal fields to pass between adjacent cavities. A plurality of adjustable screws extending radially through the body of the filter are employed to effect coupling between the orthogonal fields in the same cavity, thereby determining the frequency response of the filter.

The filter provides an asymmetric stopband response and self-equalized passband response without the need for external transmission line coupling techniques. Broadband response is achieved without spurious resonances, a high filter Q is maintained, fewer parts are required and assembly as well as tuning time is minimized. The filter of the present invention may be employed as a susceptance annulling network in order to maintain filter symmetry on a contiguous multiplexer.

BRIEF DESCRIPTION OF THE DRAWINGS

These and other more detailed and specific objects and features of the present invention are more fully disclosed in the following specification, reference being had to the accompanying drawings, in which.

DESCRIPTION OF THE PREFERRED EMBODIMENTS

Figure 1:
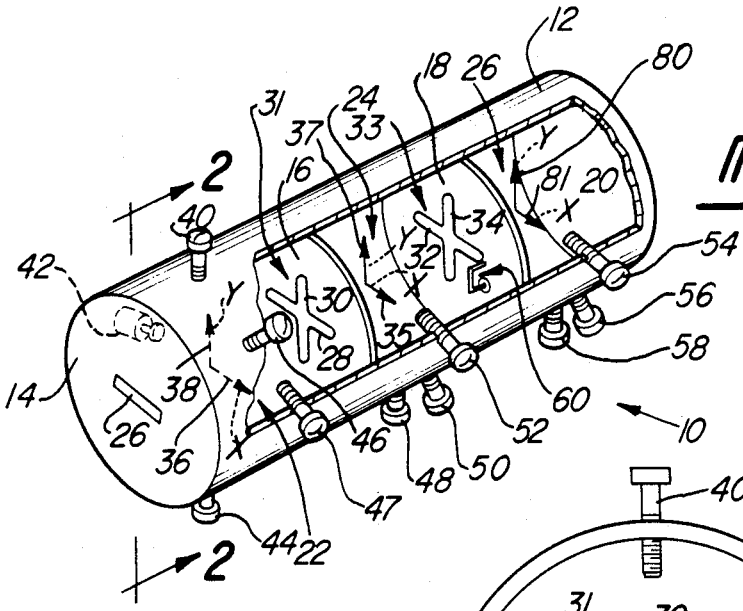
FIG. 1 is a dual mode electromagnetic waveguide filter of the present invention.
Figure 2:
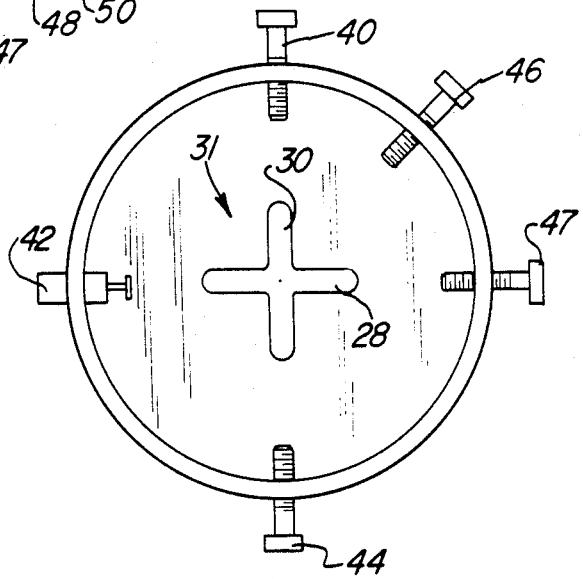
FIG. 2 is a cross-section along line 2—2 of the filter of FIG. 1.

Referring first to FIGS. 1 and 2, the present invention relates to a dual mode electromagnetic waveguide filter generally indicated by the numeral 10 in FIG. 1 which is useful, for example, in determining the frequency response of a microwave communication system. As will be explained hereinafter, the particular filter 10 chosen to illustrate the invention is a high Q dual mode reflective type having six filter sections which provides three finite frequency insertion loss poles and two poles for passband equalization.

The filter 10 broadly comprises an electrically conductive, cylindrical body 12 closed at its outer ends by end walls 14 and 20, and divided into three resonant cavities 22, 24 and 26 by a pair of longitudinally spaced partitions or septums 16 and 18. End wall 14 is provided with a rectangular slot 26 which is aligned with, what will arbitrarily be defined herein, as the X axis, that defines the input of the filter 10 and is adapted to receive an input wave. End wall 20 is imperforate and functions to reflect electromagnetic waves back toward the input end wall 14. The septums 16 and 18 are provided with axially aligned iris openings 31, 33 respectively centrally therein. Iris 31 includes a pair of intersecting slots 28, 30 which are respectively aligned along the X and Y axes. Similarly, iris 33 is defined by intersecting slots 32, 34 which are also aligned along the X and Y axes respectively. Slots 28 and 32 are axially aligned with the input slot 26.

Figure 3:
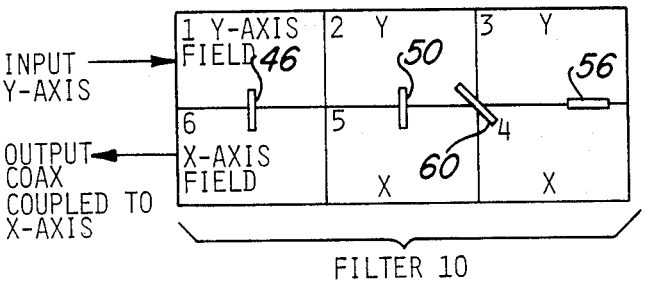
FIG. 3 is a diagramatic representation of the six sections present in the filter of FIG. 1.
Figure 6:
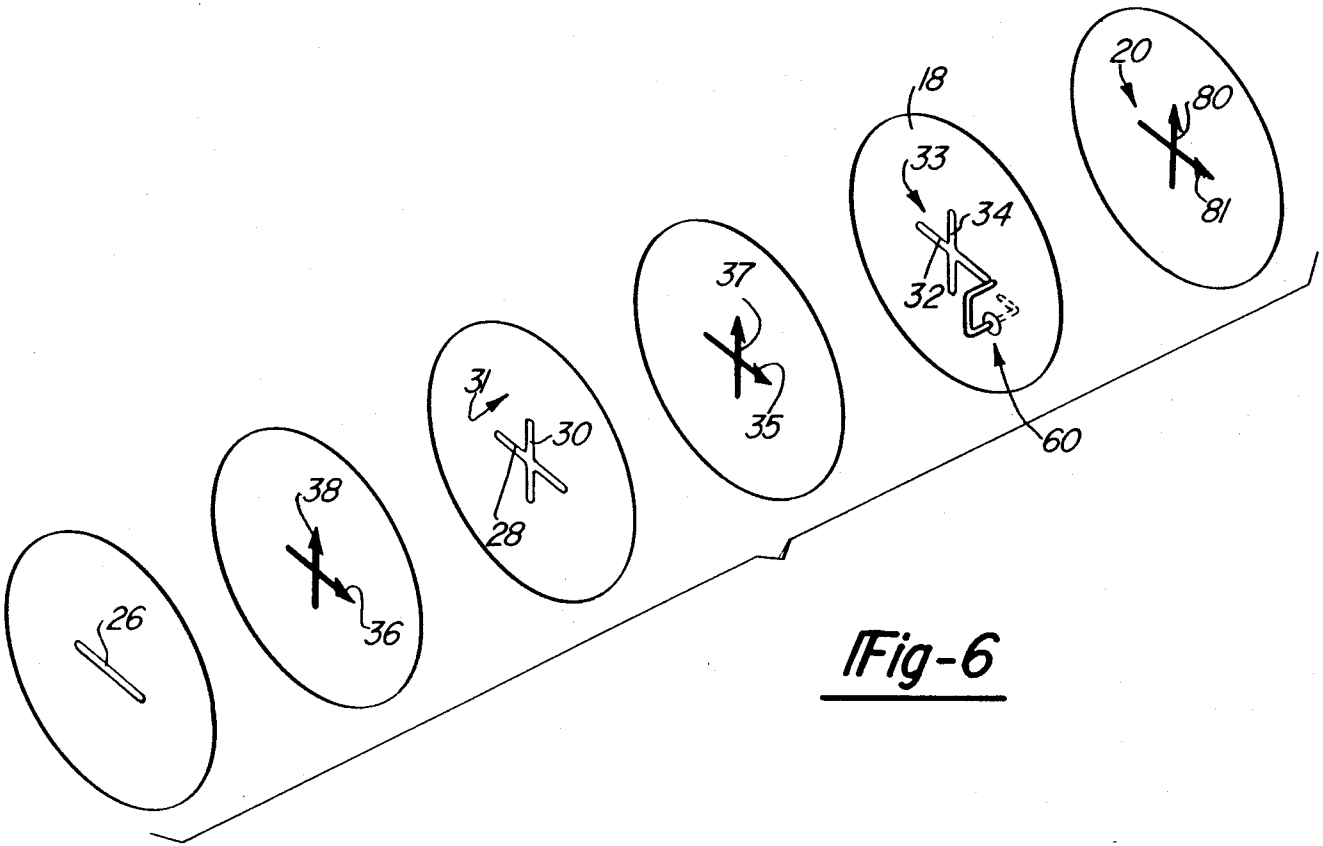
FIG. 6 is a diagramatic representation of the relationship between the electromagnetic fields in the six sections of the filter of FIG. 1 and the coupling irises between the filter resonant cavities.

Referring now also to FIGS. 3 and 6, because the filter 10 is of a dual mode type, there exists in each of the resonant cavities 22, 24 and 26 mutually orthogonal, electromagnetic fields indicated by the numerals 36, 38, 35, 37, 81, 80 respectively in FIG. 6. The components or lines 35 and 37 of cavity 24, for example, of the orthogonal field lie within planes which respectively extend parallel to the X and Y axes. The mutually orthogonal electromagnetic fields in the cavities 22, 24 and 26 define two resonances, or sections, in each of such cavities, thus, six sections are present within the filter 10. These six sections are diagrammatically indicated in FIG. 3, wherein sections 1 and 6 are present within cavity 22, sections 2 and 5 are present within cavity 24 and sections 3 and 4 are present within cavity 26. Section 1, defined by field 38, receives its input through the input opening 26, while section 6 corresponding to field 36 is coupled with an output defined by a probe 42 extending through the sidewall of the body 12, within the first cavity 22. The filter 12 may be reversed and the probe 42 could be used as the input and the slot 26 could be used as the output.

Figure 7:
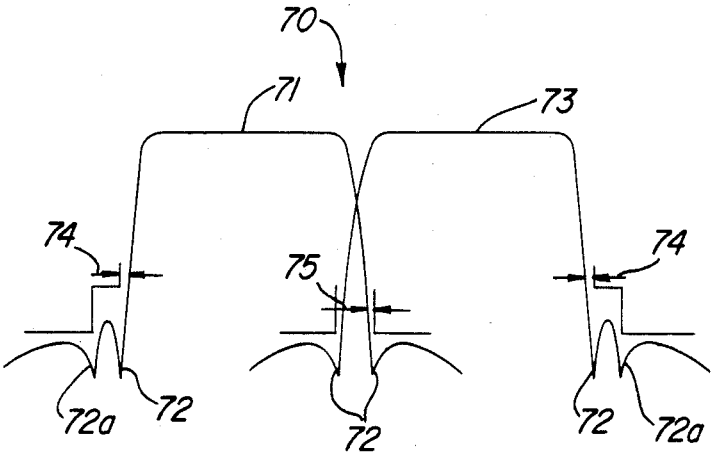
FIG. 7 depicts the frequency response of the filter of FIG. 1.

The frequencies at which the cavities 22, 24 and 26 resonate are respectively determined by screws 44, 48 and 58 which are aligned with the Y-axis and extend through the bottom of the cylindrical body 12, into the corresponding cavities 22, 24 and 26. A tuning screw 40 diametrically opposite screw 44 in cavity 22 penetrates the cavity 22 at a depth different than that of screw 44. Unequal penetration of cavity 22 by the opposing tuning screws 40 and 44, along with a later discussed coupling element 60 provide a non-symmetric stopband response which is shown in FIG. 7 and will be discussed later in more detail. The depth of penetration of tuning screws 40 and 44 along with coupling element 60, control the position of the loss poles 72 (FIG. 7) of the stopband response of the filter 10.

Three additional tuning screws 47, 52 and 54 extend through the body 12, at a position 90 degrees offset from tuning screws 44, 48, 58 and further function to aid in tuning the resonance of sections 4, 5 and 6 which correspond to the X-axis oriented field in cavities 22, 24 and 26, respectively.

Within cavity 22, the input Y-axis field 38 is slightly coupled with the output X-axis field 36 by means of a tuning screw 46 which extends through the body 12 into the cavity 22 at circumferential position midway between tuning screws 40 and 47. As indicated diagrammatically in FIG. 3, the screw 46 forms a coupling bridge between sections 1 and 6 of the filter 10. The input wave 38 passes through the horizontal slot 28 of iris 31 into cavity 24. Within cavity 24, the orthogonal fields 37 and 35 are slightly coupled with each other by a coupling bridge in the form of screw 50 which extends through the body 12 into the cavity 24 at a circumferential position midway between tuning screws 48 and 52. As shown in FIG. 3, the screw 50 functions to create a coupling bridge between sections 2 and 5 of the filter 10.

The field 37 passes through the horizontal slot 32 of iris 33 into cavity 26 as a coupled wave 80 which is reflected off of the end wall 20. A coupling screw 56 extending through the body 12 into the cavity 26, midway between tuning screws 54 and 58, together with the reflected wave functions to rotate the coupled wave 80 90 degrees. Screw 56 thus effectively couples sections 3 and 4 of the filter 10,as diagrammatically indicated in FIG. 3. The output wave 81 passes through slots 34 and 30 of irises 33 and 31 back to the cavity 22 where it is picked up by an output probe 42.

Figure 4:
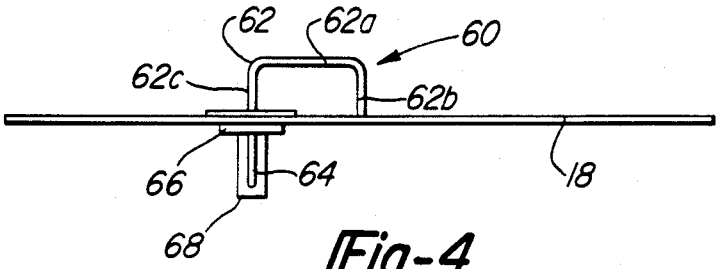
FIGS. 4 and 5 show othogonal views of the coupling element of the present invention.
Figure 5:
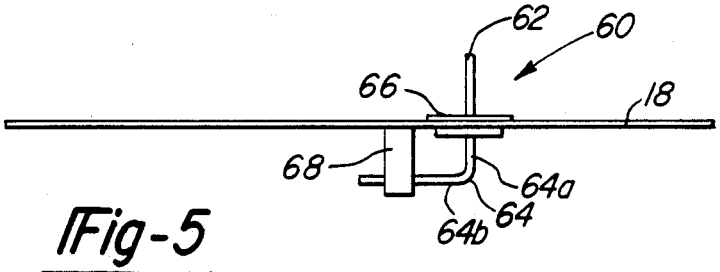

The coupling element 60 functions to electromagnetically couple the electromagnetic input field (wave) 37 in cavity 24 with the orthogonally coupled output field (wave) 81 within cavity 26. Thus, the coupling element 60 effectively provides a coupling bridge between mutually orthogonal electromagnetic fields in adjacent cavities which, in the present example, defines a coupling between sections 2 and 4 of the filter 10. Referring now also to FIGS. 4 and 5, the coupling element 60 comprises a single electrically conductive wire, such as a silver-plated copper wire, which is mounted on the septum 18 by means of an electrically insulative glass bead, coaxial feed-through 66. The coupling wire extends through the septum 18 and includes first and second portions 62 and 64 which are disposed on respective opposite sides of the septum 18. Portion 62 is substantially U-shaped in configuration, and consists of a base **62*a* and pair of parallel legs 62*b*, 62*c*. Leg 62*b* contacts the septum 18. The U-shaped portion 62 of the coupling element 60 defines a megnetic loop which lies in a plane such that its coupling axis extends parallel to the components of the Y-axis input wave 38 within cavity 24**.

The second portion 64 of the coupling element 60 is substantially L-shaped and comprises a first leg **64*a* extending perpendicular to septum 18, and second leg 64*b* which extends parallel to the septum 18. The outer extremity of leg 64*b* is supported by a strut 68 which is mounted on the septum 18 and may be formed by any suitable high dielectric material such as rexolite. Legs 64*a* and 64*b* lie in a plane perpendicular to that of the magnetic loop portion 62 and possesses an electric field coupling axis which extends parallel to the components of the X-axis output wave 81. By choosing whether these portions 62 and 64 of coupling element 60 are of the magnetic (62) or electric (64) variety and their orientation, the sign of the coupling between the diagonal sections may be determined and the particular combination of sections (either 2 and 4 or 3 and 5) is determined. The magnitude of coupling between the mutually orthogonal electromagnetic fields, and thus the tuning strength effected by the coupling element 60 is determined by the diameter of wire, the length of the leg 64*b*, the area within the magnetic loop 62 and the placement of the coupling element 60 on the septum 18. The coupling element 60** functions as an internal, integrated susceptance annulling network which may be employed to maintain filter symmetry on a contiguous multiplexer system.

FIG. 7 depicts the frequency response 70 of two multiplexed channels 71, 73 employing the filter 10 having an annulling network provided by the coupling element 60. The filter 10 employing the coupling element 60 as an annulling network creates an extra stopband pole 72*a* which results in increased rejection and margin indicated at 74 on the sides of the filter response. Filters 71 and 73 mutually interact in crossover region 75 resulting in an asymmetrical steepening of their respective passband and rejection responses. The extra stopband pole 72*a* simulates the presence of an adjacent filter by steepening the response in region 74. The result is that filters 71 and 73 have symmetrical passband responses without the need for additional susceptance annulling devices.

It is recognized that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and equivalents thereof fairly within the scope of the invention.

What is claimed is:

1. For use in an electromagnetic waveguide filter of the type having a plurality of mutually adjacent resonant waveguide cavities, said cavities being electromagnetically coupled with each other through an iris defined in a septum which separates adjacent cavities, a device for coupling first and second mutually orthogonal, electromagnetic fields respectively in said adjacent cavities, comprising:

a bent metal rod coupling element mounted on and extending through said septum.

2. The device of claim 1, wherein said rod includes:

a first portion extending into one of said adjacent cavities and electrically contacting one side of said septum, and a second portion extending into the other of said adjacent cavities and electrically insulated from said septum.

3. The device of claim 2, wherein said rod comprises a silver coated copper wire.

4. The device of claim 2, wherein said first portion includes a plurality of legs lying in a first plane and said second portion includes a plurality of legs lying in a second plane orthogonal to said first plane.

5. The device of claim 1, and further including supporting means comprising an electrically insulative member within said septum, said rod passing through and supported within said insulative member.

6. A dual mode electromagnetic waveguide filter, comprising:

a waveguide body for containing and guiding electromagnetic energy;

a partition within said waveguide body, said partition defining first and second adjacent resonant waveguide cavities, said cavities having first and second respective electromagnetic fields therein, the lines of said first and second electromagnetic fields extending in mutually orthogonal directions to each other; and, means for electromagnetically coupling the field lines of said first and second fields with each other, said coupling means including an elongate conductive element extending through said partition, said conductive element including a first portion having a magnetic loop electromagnetically coupled with said first electromagnetic field and a second portion having an electric probe electromagnetically coupled with said second electromagnetic field, said first and second portions extending away from said partition and respectively into said cavities.

7. The electromagnetic waveguide filter of claim 6, wherein said conductive element is of unitary construction having a plurality of bends therein defining a plurality of legs.

8. The electromagnetic waveguide filter of claim 7, including means on said partition for supporting at least a section of said conductive element in electrically insulated relationship to said partition.

9. The electromagnetic waveguide filter of claim 8, wherein said partition includes an aperture therein and said supporting means includes an annular supporting member formed of a dielectric material and mounted within said aperture, said conductive element extending centrally through said supporting element.

10. The electromagnetic waveguide filter of claim 6, wherein said partition includes an opening therein to allow said first and second magnetic fields to pass between said first and second cavities, said filter further including at least one, elongate electrically conductive coupling member extending through said waveguide body and into one of said cavities, said conductive member being circumferentially positioned about the axis of said waveguide body at a point resulting in mutual coupling between the mutually orthogonal electromagnetic fields in said one cavity.

11. The filter of claim 6, wherein said waveguide body is generally symmetrical in shape.

12. For use in an electromagnetic waveguide filter of the type having a plurality of mutually adjacent resonant waveguide cavities, said cavities being electromagnetically coupled with each other through an iris defined in a septum which separates adjacent cavities, a device for coupling first and second mutually orthogonal, electromagnetic fields respectively in said adjacent cavities, comprising:

an electrically conductive coupling element mounted on and extending through said septum including a first portion on one side of said septum and a second portion on the other side of said septum, said first portion having a coupling axis extending parallel to a component of said first electromagnetic field and said second portion including a coupling axis extending parallel to a component of said second electromagnetic field.

13. The device of claim 12, wherein said first portion includes a magnetic loop and said second portion includes an electric probe.

14. The device of claim 12, wherein said first portion is generally U-shaped and is defined by a bight and a pair of spaced apart legs extending away from said bight, one of said legs extending through and being electrically insulated from said septum, the other of said legs contacting said septum.

15. The device of claim 12, wherein said second portion is generally L-shaped and is defined by a first leg extending through and electrically insulated from said septum and a second leg spaced from said septum.

* * * * *